US011635271B2

(12) United States Patent
Lagenbeck

(10) Patent No.: US 11,635,271 B2
(45) Date of Patent: Apr. 25, 2023

(54) SMALL ARMS SIGNATURE SUPPRESSION TECHNOLOGY

(71) Applicant: Keith A. Lagenbeck, Keller, TX (US)

(72) Inventor: Keith A. Lagenbeck, Keller, TX (US)

( * ) Notice: Subject to any disclaimer, the term of this patent is extended or adjusted under 35 U.S.C. 154(b) by 0 days.

(21) Appl. No.: 17/341,288

(22) Filed: Jun. 7, 2021

(65) Prior Publication Data

US 2022/0049919 A1 Feb. 17, 2022

Related U.S. Application Data

(60) Provisional application No. 63/035,707, filed on Jun. 6, 2020.

(51) Int. Cl.
*F41A 21/30* (2006.01)

(52) U.S. Cl.
CPC ..... *F41A 21/30* (2013.01)

(58) Field of Classification Search
CPC ..... F41A 21/24; F41A 21/30; F41A 13/00; F41A 13/12; F41C 23/16
USPC ..... 89/14.1, 14.4; 42/71.01
See application file for complete search history.

(56) References Cited

U.S. PATENT DOCUMENTS 1,111,202 A * 9/1914 Westfall ..... F41A 21/30 89/14.4
1,173,687 A * 2/1916 Thompson ..... F41A 21/30 89/14.4
3,399,597 A * 9/1968 Perrine ..... F41A 21/30 89/14.4
7,353,741 B2 * 4/2008 Brixius ..... F41A 13/06 89/14.05
8,261,651 B2 * 9/2012 Casas Salva ..... F41A 21/30 89/14.4
8,967,325 B1 * 3/2015 Cronhelm ..... F41A 21/30 89/14.4
2005/0262997 A1 * 12/2005 Brixius ..... F41A 13/06 89/14.1
2012/0291614 A1 * 11/2012 Koumbis ..... F41A 21/30 42/78
2014/0082990 A1 * 3/2014 Lee ..... F41A 21/44 42/96
2014/0157640 A1 * 6/2014 Whelan ..... F41C 23/16 89/14.4
2016/0003570 A1 * 1/2016 Tonkin ..... F41A 21/30 89/14.4

(Continued)

FOREIGN PATENT DOCUMENTS

GB 104199 A * 2/1917 ..... F41A 21/28
GB 170249 A * 10/1921 ..... F41A 13/12
GB 356224 A * 8/1931 ..... F41A 21/36

*Primary Examiner* — Bret Hayes
(74) *Attorney, Agent, or Firm* — Lyman Moulton, Esq.; Moulton Patents, PLLC

(57) ABSTRACT

A suppressor for a firearm barrel and a barrel guard includes a primary expansion chamber and a plurality of secondary expansion chambers comprising a volume of the firearm suppressor. A plurality of fins formed into an exterior wall of the suppressor is in an intimate contact with the barrel to increase a heat transfer to an atmosphere around the suppressor. A additionally plurality of ribs is formed into the volume of the suppressor to increase a heat transfer therefrom. A plurality of holes is configured along the barrel guard to penetrate the barrel guard and promote atmospheric cooling of the barrel and the suppressor.

17 Claims, 7 Drawing Sheets

(56) References Cited

U.S. PATENT DOCUMENTS

| | | | | |
|---|---|---|---|---|
| 2017/0205175 | A1* | 7/2017 | Garst | F41A 21/30 |
| 2017/0299291 | A1* | 10/2017 | Spector | F41A 5/26 |
| 2018/0120044 | A1* | 5/2018 | Lagenbeck | F41A 21/24 |
| 2018/0347931 | A1* | 12/2018 | Schoppman | F41A 21/36 |
| 2020/0166304 | A1* | 5/2020 | Martin | F41A 21/28 |

* cited by examiner

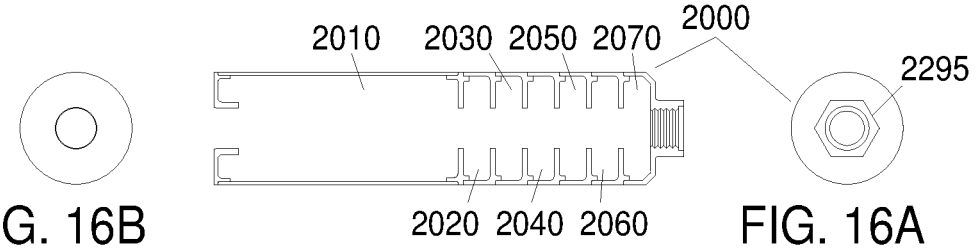
FIG. 16B FIG. 16A
FIG. 16
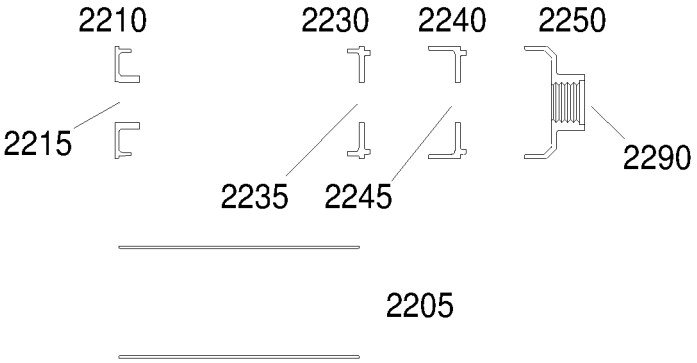
FIG. 17
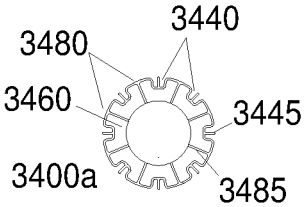
FIG. 18C
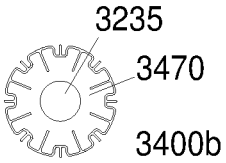
FIG. 18D
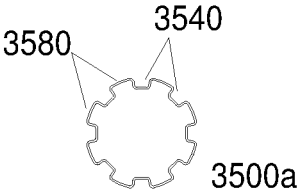
FIG. 18E
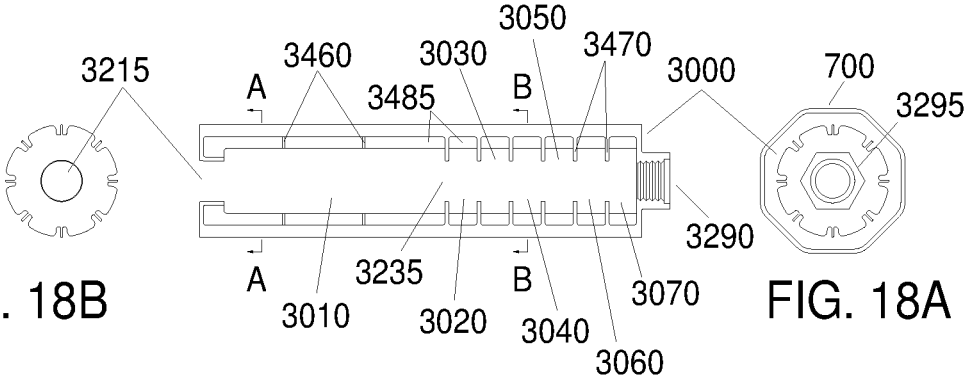
FIG. 18B FIG. 18A
FIG. 18

SMALL ARMS SIGNATURE SUPPRESSION TECHNOLOGY

CROSS-REFERENCE TO RELATED APPLICATIONS

This application claims the benefit of the priority date of earlier filed U.S. Provisional Utility Application Ser. No. 63/035,707 filed Jun. 6, 2020 by the Applicant under the same title and incorporated herein by reference in its entirety.

BACKGROUND OF THE INVENTION

A firearm sound suppressor, suppressor or sound moderator, is a muzzle device that reduces the acoustic intensity of the muzzle report (sound of a gunshot) and the recoil when a gun (firearm or air gun) is discharged, by modulating the speed and pressure of the propellant gas from the muzzle and hence suppressing the muzzle blast. Like other muzzle devices, a silencer can be a detachable accessory mounted to the muzzle, or an integral part of the barrel.

Hunters using centerfire rifles find silencers bring various important benefits that outweigh the extra weight and resulting change in the firearm's center of gravity. The most important advantage of a suppressor is the hearing protection for the shooter as well as their companions. Many hunters have suffered permanent hearing damage due to someone else firing a high-caliber gun too closely without warning. By reducing noise, recoil and muzzle-blast, it also enables the firer to follow through calmly on their first shot and fire a further carefully aimed shot without delay if necessary.

Apart from integral silencers that are integrated as a part of the firearm's barrel, most suppressors have a female threaded end, which attaches to male threads cut into the exterior of the barrel. These types of silencers are mostly used on handguns and rifles chambered in .22LR.

Military rifles such as the M16 or M14 often use quick-detach suppressors that use coarser than normal threads and are installed over an existing muzzle device such as a flash suppressor and can include a secondary locking mechanism to allow the shooter to quickly and safely add or remove a sound suppressor based on individual needs.

SUMMARY OF THE INVENTION

This application discloses category and system improvements in the suppression and reduced observability of small caliber arms. These include reduction in the audible, thermal/IR, visible flash and physical disturbance signatures of small caliber arms. These advancements individually and synergistically improve weapon function, weapon reliability, weapon flexibility, weapon durability, weapon accuracy, operator safety, safety of those nearby the weapon operator and other improvements.

A disclosed firearm suppressor includes a fully or completely and entirely surrounding and encircling over the barrel (FOTB) relation between the suppressor and a portion of the barrel wherein the suppressor comprises a primary expansion chamber and a plurality of secondary expansion chambers comprising a volume thereof. Also disclosed is a barrel guard from the receiver of the firearm forward that envelopes the barrel and the suppressor. Said barrel guard is attached in a cantilevered fashion to the firearm receiver or to the barrel nut that affixes the barrel to the upper receiver. Throughout its length, the barrel guard has no contact with the barrel, any barrel components and suppressor. The disclosure also includes a plurality of fins formed into an exterior wall of the suppressor to increase a heat transfer from the barrel and the suppressor to an atmosphere around the suppressor. The disclosure additionally includes a plurality of ribs formed into the volume of the suppressor to increase a heat transfer from the barrel and from the suppressor volume and thereto the plurality of fins of the suppressor. The disclosure further includes a plurality of holes configured along the barrel guard to promote passive atmospheric cooling of the barrel and the suppressor enveloped by the barrel guard.

Other aspects and advantages of embodiments of the disclosure will become apparent from the following detailed description, taken in conjunction with the accompanying drawings, illustrated by way of example of the principles of the disclosure.

BRIEF DESCRIPTION OF THE DRAWINGS

FIG. 16 is a depiction of suppressor 2000 in accordance with an embodiment of the present disclosure.

FIG. 16A is a depiction of suppressor 2000 in accordance with an embodiment of the present disclosure.

FIG. 16B is a depiction of suppressor 2000 in accordance with an embodiment of the present disclosure.

FIG. 17 illustrates the individual pieces of suppressor 2000 in accordance with an embodiment of the present disclosure.

FIG. 18 is a cross section view of FOTB suppressor 3000 down its major axis in accordance with an embodiment of the present disclosure.

FIG. 18A illustrates the end of FOTB suppressor 3000 viewed from the muzzle in accordance with an embodiment of the present disclosure.

FIG. 18B illustrates the end of FOTB suppressor 3000 viewed from the gas block in accordance with an embodiment of the present disclosure.

FIG. 18C illustrates the end of FOTB suppressor 3000 viewed from the gas block in accordance with an embodiment of the present disclosure.

FIG. 18D illustrates radial cross section 3400*b* in accordance with an embodiment of the present disclosure.

FIG. 18E is a cross section of a slightly different FOTB suppressor 3000 in accordance with an embodiment of the present disclosure.

Figure 1A:
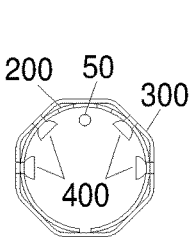
FIG. 1A is an end view of the hand guard system 100 looking from the upper receiver in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

FIGS. 1 through 4 illustrate a full-length barrel guard or hand guard system 100 intended for use on common AR15-M4-M16 type weapons. Hand guard is a familiar term in the industry and herein is used to identify a barrel guard system that fully envelopes the barrel, barrel components and the suppressor. This system and its benefits is also applied to other weapons such as AR10, bolt action rifles and the like. Full-length in this application means a hand guard system that starts at the upper receiver and extends to or slightly beyond the end of the barrel muzzle and any muzzle device or suppressor attached to the barrel.

Figure 1:
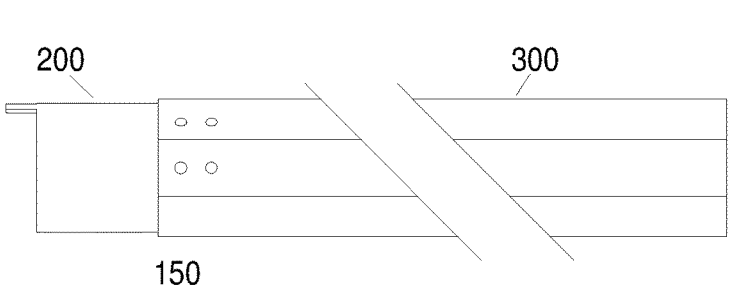
FIG. 1 is a side view of hand guard system in accordance with an embodiment of the present disclosure.

FIG. 1 is a side view of hand guard system 100, component 200 that is proximal to the upper receiver and component 300 that is farther away from the upper receiver and extends to or slightly beyond the end of the barrel or any device attached to the barrel. A portion of hand guard system 100 where component 200 fits within and attached to component 300 creates an overlap 150 of the two components.

FIG. 1A is an end view of the hand guard system 100 looking from the upper receiver. Component 200 is seen to have a circular cross section and component 300 is seen to have an octagonal cross section. Within the diameter of component 200 are the gas tube 50 and half round fastener elements 400. Although not a limitation, the material of choice in this application for hand guard component 200 and component 300 are carbon fiber tubes but could be different materials like fiberglass, aluminum and others.

Figure 2A:
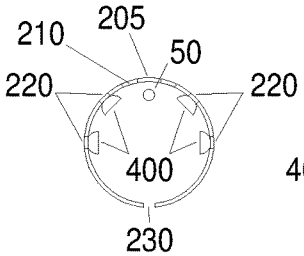
FIG. 2A is an end view of hand guard component 200 in accordance with an embodiment of the present disclosure.
Figure 2:
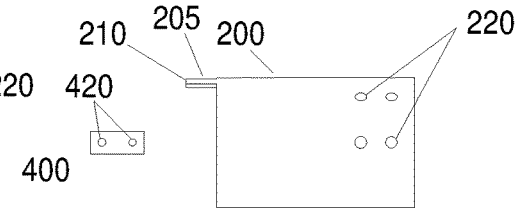
FIG. 2 is a side view of component 200 with through holes 220, tabs 210 and slot 205 for engagement and positioning with the upper receiver in accordance with an embodiment of the present disclosure.

FIG. 2 is a side view of component 200 with through holes 220, tabs 210 and slot 205 for engagement and positioning with the upper receiver. Fastening elements 400 with threaded holes 420 are used to attach component 300 to component 200.

FIG. 2A is an end view of hand guard component 200. It illustrates the location of tabs 210, slot 205 and the correspondence of holes 220 with the threaded holes 420 in fastener elements 400. At the bottom of component 200 is a full length slit 230 that allows component 200 to be securely fit and attached to the exterior surface of the rifle barrel nut. The barrel nut attaches the barrel to the male threaded end of the upper receiver. The at-rest inside diameter of component 200 is slightly bigger than the effective outside diameter of a corresponding barrel nut. Gas tube 50 is also shown.

Figure 3B:
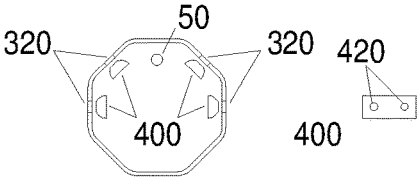
FIG. 3B is an end view of hand guard component 300 in accordance with an embodiment of the present disclosure.
Figure 3:
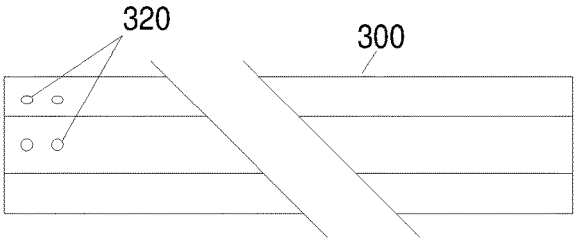
FIG. 3 is a side view of component 300 with through holes 320 in accordance with an embodiment of the present disclosure.

FIG. 3 is a side view of component 300 with through holes 320 that correspond with through holes 220 in the overlap section 150 of hand guard system 100.

FIG. 3B is an end view of hand guard component 300. It illustrates the correspondence of holes 320 with holes 220 and threaded holes 420 for affixing components of hand guard system 100 together with appropriate male threaded fasteners. The at-rest outside diameter of component 200 is nominally the same as the inside dimension between opposing flat portions of component 300. Gas Tube 50 is also shown.

Figure 4A:
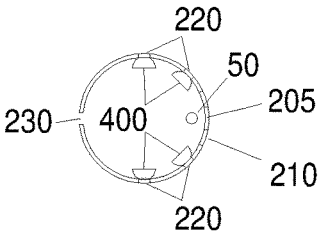
FIG. 4A is an end view of hand guard component 200 in accordance with an embodiment of the present disclosure.
Figure 4:
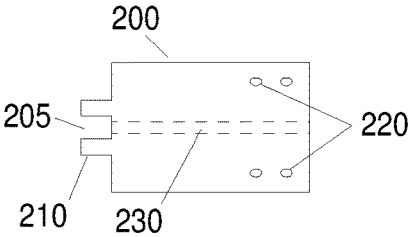
FIG. 4 is a top view of component 200 with through holes 220 in accordance with an embodiment of the present disclosure.

FIG. 4 is a top view of component 200 with through holes 220, tabs 210 and slot 205 for engagement and position with the upper receiver. Full-length slot 230 is shown in phantom dashed lines.

FIG. 4A is an end view of hand guard component 200. It illustrates the location of tabs 210, slot 205 and the correspondence of holes 220 with the threaded holes 420 in fastener elements 400. At the bottom of component 200 is full length slit 230 that allows component 200 to securely fit to the rifle barrel nut that attaches the barrel to the male threaded end of the upper receiver. The at-rest inside diameter of component 200 is slightly bigger than the effective outside diameter of a corresponding barrel nut. Gas tube 50 is also shown.

Figure 5A:
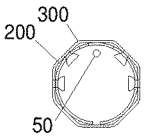
FIG. 5A is the same as FIG. 1*a* in accordance with an embodiment of the present disclosure.
Figure 5:
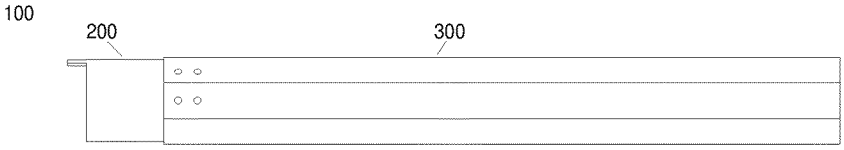
FIG. 5 is a side view of hand guard system 100 in accordance with an embodiment of the present disclosure.

Except for the interruption of the length of component 300 as depicted in FIG. 1, FIG. 5 is a side view of hand guard system 100 and essentially the same as FIG. 1. FIG. 5A is the same as FIG. 1A and is an end view of an embodiment of the present disclosure.

Figure 6A:
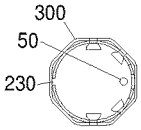
FIG. 6A is a side view of the hand guard system 100 with components shown with uninterrupted length in accordance with an embodiment of the present disclosure.
Figure 6:
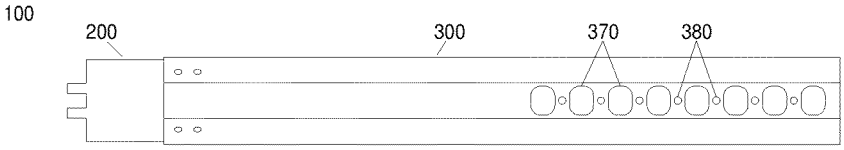
FIG. 6 is a top view of hand guard system 100 with component 300 shown with uninterrupted length in accordance with an embodiment of the present disclosure.

FIG. 6 is a top view of hand guard system 100 with component 300 shown with uninterrupted length. Component 300 has optional holes 370 and holes 380 in the upper horizontal panel of the octagonal tube 300. Holes 370 and 380 are shown to commence about midpoint of component 300 length. Holes 380 would typically be used for mounting sighting devices or other accessories such as lights. The intended function of holes 370 is to allow heat coming from the barrel and suppressor to exit to atmosphere. Holes 370 and 380 may be entirely excluded, forcing accumulated heat from barrel and suppressor to exit the distal end of hand guard system component 300.

FIG. 6A is a end view of an embodiment of the present disclosure.

Figure 7A:
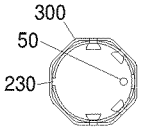
FIG. 7A is a side view of the hand guard system of FIG. 7 in accordance with an embodiment of the present disclosure.
Figure 7:
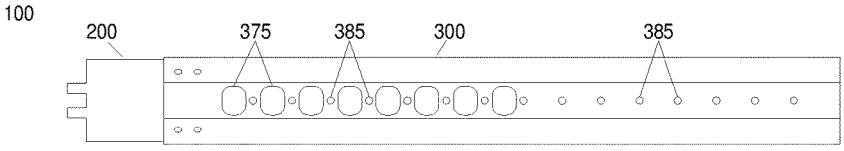
FIG. 7 is a bottom view of hand guard system with component 300 shown uninterrupted in accordance with an embodiment of the present disclosure.

FIG. 7 is a bottom view of hand guard system with component 300 shown uninterrupted. Component 300 has optional holes 375 and holes 385 in the lower horizontal panel of the octagonal tube 300. Holes 375 and 385 are shown to commence just after the overlap section 150 of hand guard system 100. Holes 385 would typically be used for mounting vertical hand grip devices, bipods or other accessories such as lights. The intended function of holes 375 would allow atmospheric air to rise and enter hand guard system 100 and provide passive convection cooling of the barrel and suppressor. Holes 375 and 385 may be entirely excluded, forcing passive convection cooling air to be drawn in through openings in and around the barrel nut to which component 200 is affixed.

The description herein above for hole locations in the upper and lower horizontal panels of component 300 are only examples. Various combinations and locations are anticipated in this disclosure. Although not shown holes 385 are anticipated along any of the non-horizontal panels of component 300 for the mounting of accessory devices. It is intended that all six panels of the non-horizontal panels would have no open or unfilled penetrations to prevent line of sight into hand guard system 100.

Hand guard system 100 fully envelopes the barrel, gas block, gas tube and attached devices like a suppressor. The absence of open or unfilled holes in the six non-horizontal panels in conjunction with the insulating nature of carbon fiber versus metals like aluminum cloaks the thermal signature of the barrel, gas tube, gas block and suppressor from night or infrared vision equipment.

The full length, carbon fiber hand guard described herein would also prevent contact burns due to accidental grabbing of a hot barrel/suppressor or bumping into someone with an exposed, hot suppressor.

FIG. 7A is an end view of an embodiment of the present disclosure.

Figure 8A:
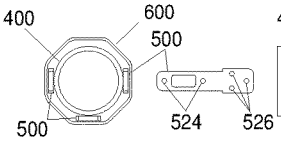
FIG. 8A is an end view of the circular hand guard 400 combined with the octagonal carbon fiber extension 600 in accordance with an embodiment of the present disclosure.
Figure 8:
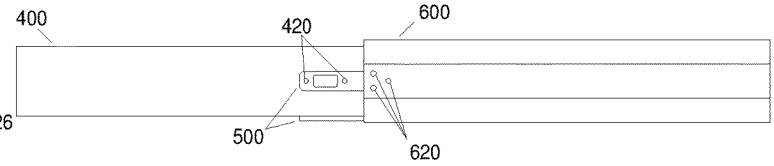
FIG. 8 is a side view of a different hand guard system combining common or existing aluminum hand guard 400 in accordance with an embodiment of the present disclosure.

FIG. 8 is a side view of a different hand guard system combining common or existing aluminum hand guard 400.

Octagonal carbon fiber section 600 is shown in an abutting relationship to the distal end of hand guard 400. Mounting tab 500 would bridge between and connect hand guard 400 and carbon fiber section 600. Mounting tab 500 would have fastening holes that align with corresponding holes 420 and holes 620. FIGS. 8 and 8*a* illustrate an arrangement with mounting tab 500 on the outside of hand guard 400 and the inside of carbon fiber section 600. The connection of hand guard 400 with carbon fiber section 600 by mounting tab 500 as described herein is not a limitation. Hand guard 400 could just as well overlap 600 on the outside or abut with 600.

FIG. 8A is an end view of the circular hand guard 400 combined with the octagonal carbon fiber extension 600. Mounting tab 500 has holes 524 that align with holes 420 and holes 526 that align with holes 620. Mounting tab 500 overlaps the exterior of hand guard 400 and under-laps or fits within the interior dimension of carbon fiber extension 600.

Figure 9A:
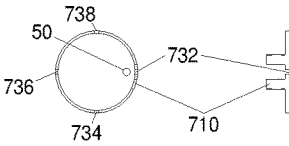
FIG. 9A illustrates four slots, 732, 734, 736 and 738 arranged at even intervals in the circular cross section in accordance with an embodiment of the present disclosure.
Figure 9:
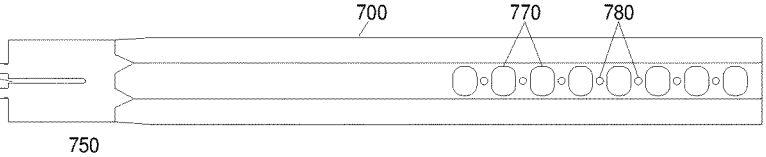
FIG. 9 illustrates four slots, 732, 734, 736 and 738 arranged at even intervals in the circular cross section in accordance with an embodiment of the present disclosure.

FIG. 9 is a top view of single piece hand guard system 700 and is similar to hand guard system 100. The chief difference is section 750, which transitions from a circular cross section to octagonal cross section. The transition 750 corresponding to overlap 150 seen in FIGS. 1, 5, 6 and 7. Hand guard 700 has optional holes 770 and holes 780 in the upper horizontal panel of the octagonal portion of tube 700. Holes 770 and 780 are shown to commence about midpoint of the octagonal portion of hand guard 700. Holes 780 would typically be used for mounting sighting devices or other accessories such as lights. The intended function of holes 770 would allow heat coming from the barrel and suppressor when fired to exit to atmosphere. Holes 770 and 780 may be entirely excluded, forcing accumulated barrel and suppressor heat to exit at the distal end of hand guard system 700. The function and location of holes 770 and 780 are analogous to holes 370 and 380 without limitation.

FIG. 9A is an end view of an embodiment of the present disclosure. FIGS. 9 and 9A illustrate four slots, 732, 734, 736 and 738 arranged at even intervals in the circular cross section. Like slit 230 in component 200, these slits allow for the hand guard system 700 to be securely fit and attached to the barrel nut. The illustration of four slits in FIGS. 9 and 9*a* are not a limitation as more than four and less than four could be employed to accomplish the intended function. Details and features described in FIGS. 5, 6 and 7 may apply for the monolithic, single piece hand guard system 700.

The full envelopment of the barrel and attached devices must include the direct impingement gas tube or piston operating system that uses high pressure propellant gases from the barrel to unlock, open and cycle the action, removing the spent case and loading a new round into the chamber. FIGS. 10*a* through 10*h* illustrate versions of barrel nuts for AR15 type weapons that have gas tube 50 over the barrel.

One category of common barrel nuts has an outside diameter small enough such that it fits under the bottom edge of the gas tube 50. Other barrel nuts have larger outside diameters and numerous, evenly spaced windows or slots, typically 20 evenly spaced, to allow clearance for the gas tube 50 when the barrel nut is tightened to the upper receiver. When there is interference between the gas tube and the timing windows of the barrel nut, the barrel nut is loosened, and shim washers are added to correct any interference. Barrel nuts 820, 840 and 860 have outside diameters sufficient to allow full envelopment of gas tube 50 within hand guard systems 100 and 700. Barrel nuts 820, 840 and 860 would be precision manufactured with internal threads specifically "timed" with the external threads of the upper receiver to reliably provide clearance for the gas tube 50 when properly torqued.

Figure 10A:
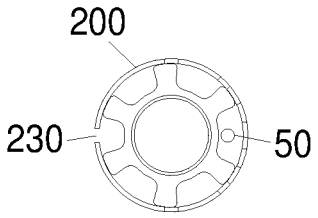
FIG. 10A illustrates barrel nut 820 in intimate contact with the inside surface of hand guard component 200 in accordance with an embodiment of the present disclosure.
Figure 10:
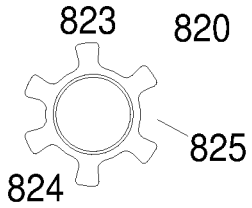
FIG. 10 illustrates barrel nut 820 in intimate contact with the inside surface of hand guard component 200 in accordance with an embodiment of the present disclosure.

FIGS. 10 and 10B illustrate barrel nut 820 in intimate contact with the inside surface of hand guard component 200. Gas tube 50 is contained within component 200. Barrel nuts 820 would be registered/timed before machining and threaded identically to ensure that void or space 825 is positioned to allow unobstructed passage of gas tube 50 into the upper receiver of the AR15 rifle without the need of shims. Barrel nut 820 is shown to have six legs or spokes 823 and five voids or spaces 824 that are not 825.

Figure 10C:
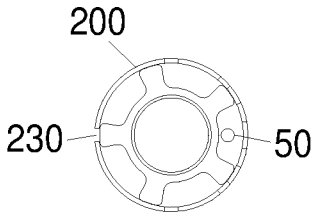
FIG. 10C illustrates barrel nut 840 in intimate contact with the inside surface of hand guard component 200 in accordance with an embodiment of the present disclosure.
Figure 10D:
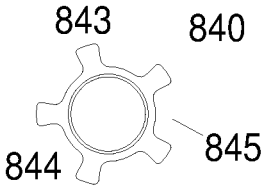
FIG. 10D illustrates barrel nut 840 in intimate contact with the inside surface of hand guard component 200 in accordance with an embodiment of the present disclosure.

FIGS. 10C and 10D illustrate barrel nut 840 in intimate contact with the inside surface of hand guard component 200. Gas tube 50 is contained within component 200. Barrel nuts 840 would be registered/timed before machining and threaded identically to ensure that void or space 845 is positioned to allow unobstructed passage of gas tube 50 into the upper receiver of the AR15 rifle without the need of shims. Barrel nut 840 is shown to have five legs or spokes 843 and four voids or spaces 844 that are not 845.

Figure 10E:
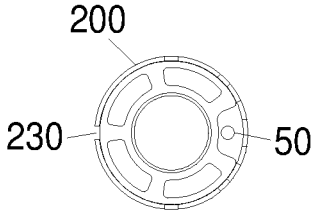
FIG. 10E illustrates barrel nut 860 in intimate contact with the inside surface of hand guard component 200 in accordance with an embodiment of the present disclosure.
Figure 10F:
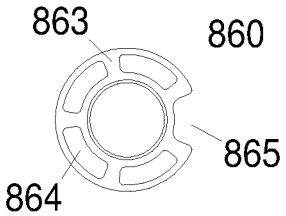
FIG. 10F illustrates barrel nut 860 in intimate contact with the inside surface of hand guard component 200 in accordance with an embodiment of the present disclosure.

FIGS. 10E and 10F illustrate barrel nut 860 in intimate contact with the inside surface of hand guard component 200. Gas tube 50 is contained within component 200. Barrel nuts 860 would be registered/timed the same before machining and threaded identically to ensure that void or space 865 is positioned to allow unobstructed passage of gas tube 50 into the upper receiver of the AR15 rifle without the need of shims. Barrel nut 860 is shown to have five spokes 863 and four voids or spaces 864 that are not 865.

Figure 10G:
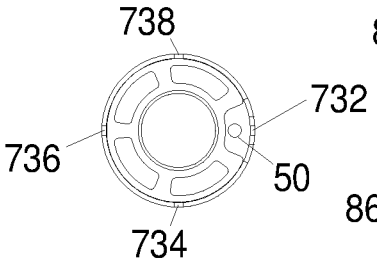
FIG. 10G illustrates a barrel nut in intimate contact with an inside surface of the hand guard component in accordance with an embodiment of the present disclosure.
Figure 10H:
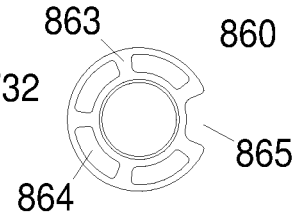
FIG. 10H illustrates a barrel nut in intimate contact with an inside surface of the hand guard component in accordance with an embodiment of the present disclosure.

FIGS. 10G and 10H illustrate barrel nut 860, also seen in FIGS. 10*e* and 10*f*, in intimate contact with the inside surface of hand guard 700. Gas tube 50 is contained within component 200.

Figure 9B:
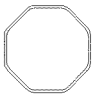
FIG. 9B is an end view of FIG. 9 in accordance with an embodiment of the present disclosure.
Figures 11, 11A, 11B:
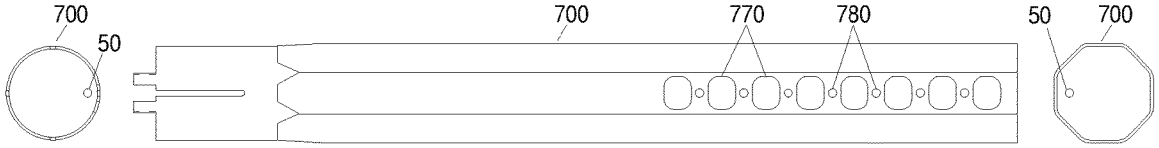
FIG. 11 illustrates four slots arranged at even intervals in the circular cross section in accordance with an embodiment of the present disclosure in accordance with an embodiment of the present disclosure.
FIG. 11A is an end view looking back on the barrel in accordance with an embodiment of the present disclosure.
FIG. 11B is an end view looking on forward on the barrel in accordance with an embodiment of the present disclosure.

FIGS. 11, 11A and 11B are essentially the same as FIGS. 9, 9A and 9B. FIGS. 11, 11A and 11B are provided for visual reference with FIGS. 12 through 15A inclusive according to embodiments of the present disclosure.

Figures 12, 12A:
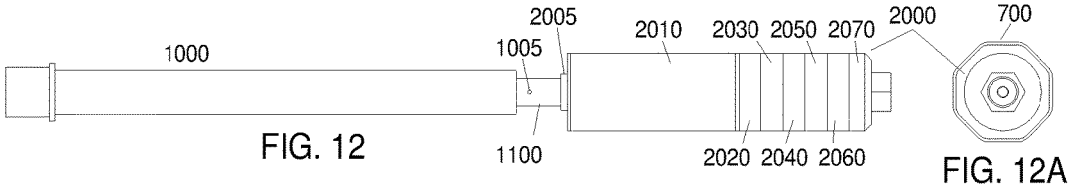
FIG. 12 is a top view of rifle barrel 1000 with gas block vent hole 1005 and barrel journal 1100 over which a gas block resides in accordance with an embodiment of the present disclosure.
FIG. 12A is an end view of the barrel in accordance with an embodiment of the present disclosure.

FIG. 12 is a top view of rifle barrel 1000 with gas block vent hole 1005 and barrel journal 1100 over which a gas block resides. Gas block is not shown for reasons of clarity. Located between the gas block and suppressor 2000 is a common split lock washer 2005, which is compressed when suppressor 2000 is screwed fully on to the threaded muzzle of the barrel 1000. When suppressor 2000 is fully attached and lock washer compressed, the suppressor body becomes a stressed member of the barrel increasing barrel stiffness. Suppressor 2000 is comprised of a primary expansion chamber 2010 and six subsequent secondary expansion or baffle chambers, 2020, 2030, 2040, 2050, 2060 and 2070. FIG. 12*a* is an end view of suppressor 2000 located within hand guard 700. Suppressor 2000 resides fully over the barrel (FOTB) with respect to barrel 1000.

FIG. 12A is an end view of an embodiment of the present disclosure.

Figures 13, 13A:
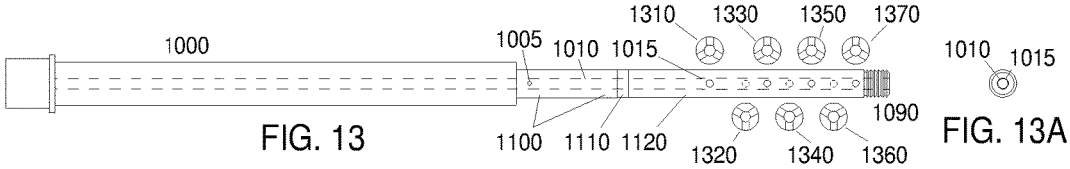
FIG. 13 is a top view of barrel 1000 that illustrates gas block journal section 1100 and barrel section 1110, which is a transition to barrel section 1120 in accordance with an embodiment of the present disclosure.
FIG. 13A is an end view of barrel 1000 in accordance with an embodiment of the present disclosure.

FIG. 13 is a top view of barrel 1000 that illustrates gas block journal section 1100 and barrel section 1110, which is a transition to barrel section 1120. Barrel section 1120 has a slightly smaller outside diameter than barrel journal 1100. Phantom dashed line 1010 represents the caliber bore and rifling of barrel 1000. Phantom dashed line 1015 represents the point to where the rifling 1010 has been removed by counter boring barrel 1000 from the muzzle back toward the breech. The internal diameter of counter bore section 1015 is slightly greater than the caliber groove diameter of rifled barrel 1000. Outside diameter of muzzle threads 1090 is nominally the same as barrel section 1120. Representative numerical value for barrel journal 1100 would be 0.6245", barrel section 1120 would be 0.620" and ⅝×11 UNC for threaded muzzle section 1090.

Immediately after the rifled bore 1010 ends and smooth bore 1015 has commenced, a series of holes penetrate the barrel to vent propellant gases into the FOTB suppressor 2000. Cross section 1310 of barrel 1000 vents propellant gases into the primary expansion chamber 2010. Cross section 1320 of barrel 1000 vents propellant gases into the first secondary expansion or baffle chamber 2020. Cross section 1330 of barrel 1000 vents propellant gases into the second secondary expansion or baffle chamber 2030. Cross section 1340 of barrel 1000 vents propellant gases into the third secondary expansion or baffle chamber 2040. Cross section 1350 of barrel 1000 vents propellant gases into the fourth secondary expansion or baffle chamber 2050. Cross section 1360 of barrel 1000 vents propellant gases into the fifth secondary expansion or baffle chamber 2060. Cross section 1370 of barrel 1000 vents propellant gases into the sixth secondary expansion or baffle chamber 2070.

FIG. 13A is an end view of barrel 1000 and illustrates counter bore 1015 as slightly larger than rifled bore 1010. Representative values for counter bore 1015 would be 0.250" and rifled bore 1010 would be 0.224".

Figures 14, 14A:
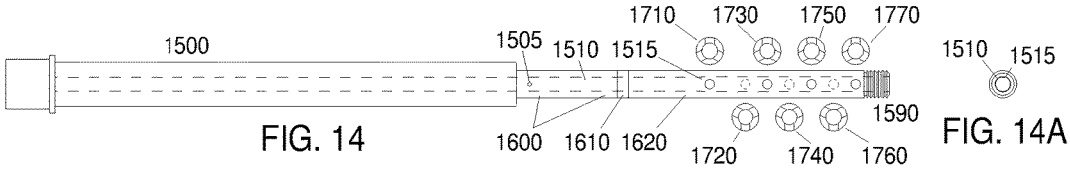
FIG. 14 is a top view of barrel 1500 that illustrates gas block journal section 1600, barrel section 1610 which is a transition to barrel section 1620 in accordance with an embodiment of the present disclosure.
FIG. 14A is an end view of barrel 1500 in accordance with an embodiment of the present disclosure.

FIG. 14 is a top view of barrel 1500 that illustrates gas block journal section 1600, barrel section 1610 which is a transition to barrel section 1620. Barrel section 1620 has a slightly smaller outside diameter than barrel journal 1600. Phantom dashed line 1510 represents the caliber bore and rifling of barrel 1500. Phantom dashed line 1515 represents the point to where the rifling 1510 has been removed by counter boring barrel 1500 from the muzzle back toward the breech. The internal diameter of counter bore section 1515 is slightly greater than the caliber groove diameter of rifled barrel 1500. Outside diameter of muzzle threads 1590 is nominally the same as barrel section 1620. Representative numerical value for barrel journal 1600 would be 0.6245", barrel section 1620 would be 0.620" and ⅝×11 UNC for threaded muzzle section 1590.

Immediately after the rifled bore 1510 end and smooth bore 1515 has commenced, a series of holes penetrate the barrel to vent propellant gases into the FOTB suppressor 2000. Cross section 1710 of barrel 1500 vents propellant gases into the primary expansion chamber 2010. Cross section 1720 of barrel 1500 vents propellant gases into the first secondary expansion or baffle chamber 2020. Cross section 1730 of barrel 1500 vents propellant gases into the second secondary expansion or baffle chamber 2030. Cross section 1740 of barrel 1500 vents propellant gases into the third secondary expansion or baffle chamber 2040. Cross section 1750 of barrel 1000 vents propellant gases into the fourth secondary expansion or baffle chamber 2050. Cross section 1760 of barrel 1500 vents propellant gases into the fifth secondary expansion or baffle chamber 2060. Cross section 1770 of barrel 1500 vents propellant gases into the sixth secondary expansion or baffle chamber 2070.

FIG. 14A is an end view of barrel 1500 and illustrates counter bore 1515 as slightly larger than rifled bore 1510. Representative values for counter bore 1515 would be 0.350" and rifled bore 1510 would be 0.323".

Among the benefits of the barrel design illustrated in FIGS. 13 and 14 and described above is the ability to shoot sabot rounds without the risk of the sabot opening and jamming within the suppressor. Sabot rounds are well known tank munitions used to fire sub-bore diameter, long solid metal projectiles to defeat armor of opposing tanks. A similar barrel design seen in FIGS. 13 and 14 and properly sized for 50 BMG could safely fire the Sabot Light Armor Piercing (SLAP) round through a Fully Over The Barrel suppressor without the risk of the sabot opening and jamming the suppressor. A process known as Extrude Honing or Abrasive Flow Machining could be used to radius or smooth the inside hole edges that vent propellant gases into the FOTB suppressor.

The same FOTB suppressor 2000 would be fully functional, without degraded performance, and interchangeable for either barrel 1000 or barrel 1500. The outside diameter of either barrel being the same, the space occupied by the FOTB suppressor being the same and the muzzle thread being the same allows for the same FOTB suppressor 2000 to be used for various calibers and weapons. To function optimally, typical suppressors are sized for a specific bullet caliber. A conventional 0.224" suppressor with baffles sized slightly larger than 0.224" and less than 0.323" would fail catastrophically if attached to a 0.323" bore rifle. A conventional 0.323" suppressor with baffles sized slightly larger than 0.323" would function for a 0.224" bore rifle but the larger baffle holes allow for gases to bypass the projectile and reduce sound attenuation of the suppressor.

Figures 15, 15A:
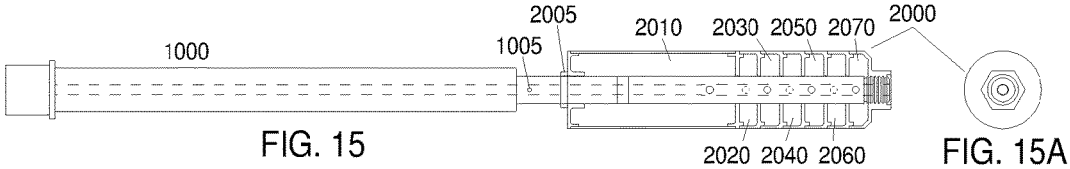
FIG. 15 is a top view in accordance with an embodiment of the present disclosure.
FIG. 15A is an end view of the barrel in accordance with an embodiment of the present disclosure.

FIG. 15 is a top view and essentially the same as FIG. 12 with suppressor 2000 shown in cross section down the bore of barrel 1000.

FIG. 15A is an end view of an embodiment of the disclosure.

FIGS. 16, 16A and 16B are suppressor 2000 as seen in FIG. 1500 but removed from the barrel 1000. FIG. 16 illustrates suppressor 2000 removed and shown in cross section down the bore of barrel 1000. FIG. 16B illustrates an end view of FOTB suppressor 2000 from the gas block. FIG. 16A illustrates an end view of FOTB suppressor 2000 from the muzzle.

FIG. 17 illustrates the individual pieces of suppressor 2000 shown separate and apart. The inside diameter 2215 of bushing end cap 2210 fits over the journal section of 1100 of barrel 1000. Bushing end cap 2210 and would be seam welded to one end of tube section 2205. The face of bushing end cap 2210 is illustrated in FIG. 16*b*. It is anticipated that bushing end cap 2210 would be machined from stainless steel round rod or other suitable material. Tube section 2205 would be cut to length from tube stock of appropriate size stainless steel or other suitable material.

Component 2230 would be seam welded to tube section 2205 opposite of bushing end cap 2210. Component 2230 would be machined from stainless steel rod or other suitable material. The combination of 2210, 2205 and 2230 create the primary expansion chamber 2010. Component 2230 has an inside diameter of 2235.

After component 2230 in the construction of FOTB suppressor 2000 would be five identical pieces of component 2240, which would likewise be machined from stainless steel rod or other suitable materials. The first of component 2240 would be seam welded to 2230 and then to the next component 2240 and so forth. All five components 2240 would have similar inside diameters 2245. Component 2230 and first component 2240 create the secondary expansion or baffle chamber 2020. Seam welding of the remaining components 2240 generate consecutive secondary expansion or baffle chambers 2030, 2040, 2050 and 2060. The last machined components 2250 would be seamed welded to the final machined component 2240 to generate secondary expansion or baffle chamber 2070. Machined component 2250 also includes internal threads that match the external threads of barrel 1000. Machined component 2250 includes concentric hexagonal surface 2295 for use with conventional sockets and wrenches to securely attach FOTB suppressor 2000 to barrel 1000 while compressing spiral spring lock washer 1005 flat against and between the rifle gas block and FOTB suppressor 2000.

FIG. 18 is a cross section view of FOTB suppressor 3000 down its major axis. FOTB suppressor 3000 is analogous to FOTB suppressor 2000 but utilizes 3D printed metal processes to create external and internal architecture not possible with conventional CNC machining equipment, investment casting or other methods. Unique external and internal architecture of FOTB suppressor 3000 increases heat transfer from the propellant gases to suppressor 3000 and from suppressor 3000 to atmosphere due to increased surface area. Thinner nominal material thickness increases heat transfer from the propellant gases to suppressor 3000 and from suppressor 3000 to atmosphere. Bursting strength of suppressor 3000 is increased due to internal and external ribbing and outer wall corrugation.

Thinner material thickness reduces weight of suppressor 3000 which invites use of expensive materials like beryllium copper with its dramatically higher thermal conductivity. Very little material is wasted in 3D metal printing, which also invites use of materials like beryllium copper. FOTB suppressor 3000 is monolithic with no interruptions or gaps in the material, which are common in conventional suppressors with stacked baffles or baffle monocore enclosed within a separate tube and end caps.

FOTB suppressor 3000 is illustrated with internal and external elements or ribs that run parallel to the major axis. The flexibility of 3D printing, aka additive manufacturing, allows for FOTB suppressor 3000 to have a spiral or rotating architecture like the rifling of a barrel. 3D printing of FOTB suppressor 3000 in a spiral format increases internal and external surface area for greater heat transfer and increases overall mechanical strength to resist internal gas pressure.

FOTB suppressor 3000 is similar to FOTB suppressor 2000 with primary expansion chamber 3010 and secondary expansion or baffle chambers 3020, 3030, 3040, 3050, 3060 and 3070. External opening 3215 closest to the gas block, internal openings 3235, threaded end 3290 and external hex shape 3295 are similar to the analogues found in FOTB suppressor 2000. Suppressors 3000 and 2000 are intended to be fully interchangeable.

FIG. 18A illustrates the end of FOTB suppressor 3000 viewed from the muzzle. FIG. 18B illustrates the end of FOTB suppressor 3000 viewed from the gas block.

FIG. 18C illustrates radial cross section 3400*a* at A-A of a full size FOTB suppressor 3000. External troughs 3440 recess down and in towards the major axis. External heat transfer ribs 3445 are found within the space created by external troughs 3440. Between external troughs 3440 are external surface sections 3480. From the interior surface of surface sections 3480, internal heat transfer ribs 3485 extend down and toward the major axis of FOTB suppressor 3000.

The depth of external troughs 3440, measured as the difference in the radius to the outside surface of the suppressor less the radius to outside surface of trough 3440, is twice the nominal wall thickness or greater.

The height of external heat transfer ribs 3445 is twice the suppressor nominal wall thickness or greater. The height of internal heat transfer ribs 3485 is twice the suppressor nominal wall thickness or greater.

Radial partitions 3460 are illustrated within primary expansion chamber 3010. Radial partitions 3460 extend from the internal surfaces of trough 3440 and surface sections 3460 toward the major axis. The inside diameter of radial partitions 3450 is sufficiently larger than the outside diameter of barrel 1000 so that entering propellant gases can fill primary expansion chamber 3010 unrestricted.

FIG. 18D illustrates radial cross section 3400*b* at B-B of a full size FOTB suppressor 3000. Radial partitions 3470 separate the secondary expansion of baffle chambers 3020, 3030, 3040, 3050, 3060, and 3070 from the each other and the primary expansion chamber 3010. Radial partitions 3470 extend from the internal surfaces of trough 3440 and surface sections 3460 toward the major axis. The inside diameter 3235 of radial partitions 3470 is slightly larger than the outside diameter of barrel 1000 and sufficiently close to barrel outside diameter to retain entering propellant gases. The inside diameters 3235 of suppressor 3000 are essentially the same as internal diameters 2235 of suppressor 2000.

FIG. 18E is a cross section of a slightly different FOTB suppressor 3000, but without heat transfer ribs 3445, ribs 3485 or radial partition 3460 in accordance with an embodiment of the present disclosure.

Figure 18F:
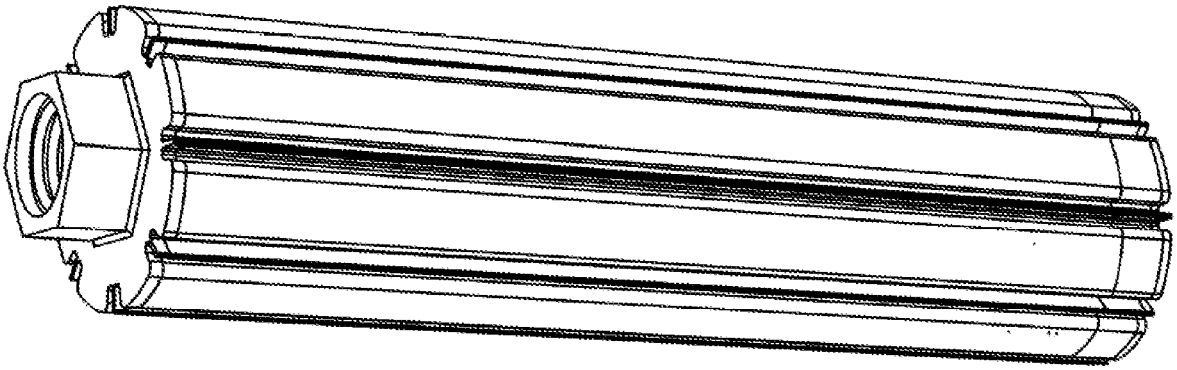
FIG. 18F is a 3D image of FOTB suppressor 3000 in accordance with an embodiment of the present disclosure.

FIG. 18F is a 3D image of FOTB suppressor 3000 in accordance with an embodiment of the present disclosure.

Figure 18G:
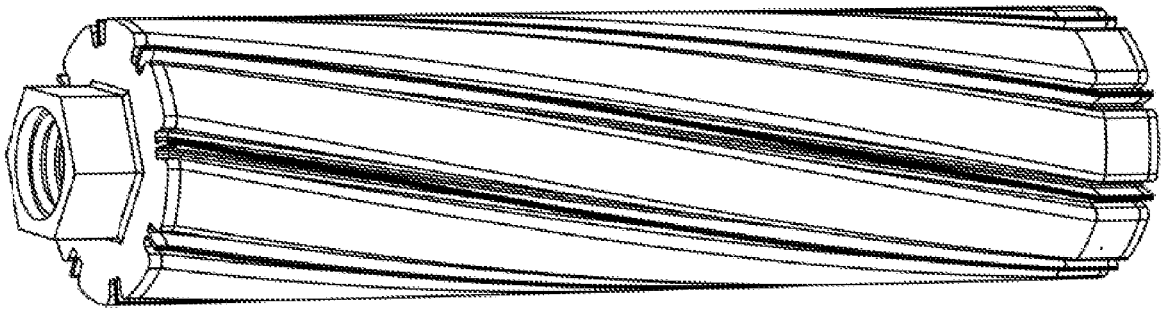
FIG. 18G is a 3D image of a FOTB suppressor 3000 with a helical architecture in accordance with an embodiment of the present disclosure.

FIG. 18G is a 3D image of a FOTB suppressor 3000 with a helical architecture in accordance with an embodiment of the present disclosure. The plurality of fins and the plurality of ribs are formed helically along at least a portion of a length of the suppressor. Spherical embodiments are also included in the disclosure. The resulting primary and secondary chambers are accordingly helical and spherical. The helical and spherical architecture gives lateral and radial stiffness and support to the suppressor heat transfer properties as well by distributing surface area around a circumference of the disclosed devices.

Figure 19C:
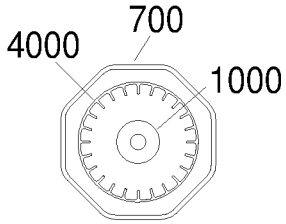
FIG. 19C illustrate 3D printed suppressor 4000 in accordance with an embodiment of the present disclosure.
Figures 19, 19A, 19B:
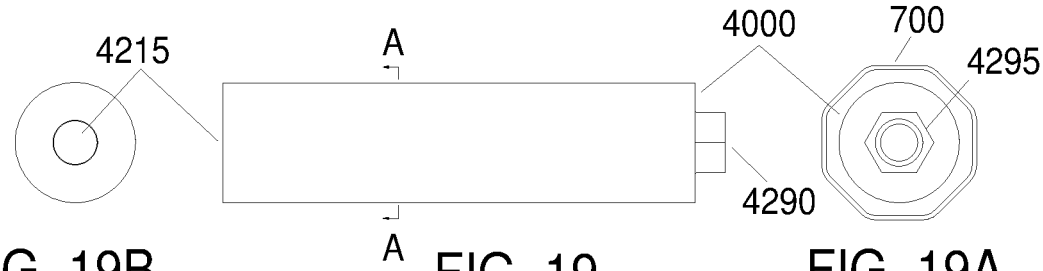
FIG. 19 illustrates 3D printed suppressor 4000 in accordance with an embodiment of the present disclosure.
FIG. 19A illustrates 3D printed suppressor 4000 in accordance with an embodiment of the present disclosure.
FIG. 19B illustrates 3D printed suppressor 4000 in accordance with an embodiment of the present disclosure.

FIGS. 19, 19A and 19B through 19C illustrate 3D printed suppressor 4000 with a smooth exterior and internal longitudinal ribs. The internal architecture of suppressor 4000 would be similar to suppressor 2000. FIG. 19*c* is a cross section in the primary expansion chamber of suppressor 4000.

Figure 20:
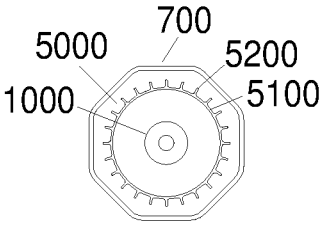
FIG. 20 illustrates 3D printed suppressor 5000 in accordance with an embodiment of the present disclosure.

FIG. 20 illustrates 3D printed suppressor 5000 with a smooth interior and external longitudinal ribs. The internal architecture of suppressor 5000 would be analogous to suppressor 2000. FIG. 20 is a cross section in the primary expansion chamber of suppressor 5000. The height of fins 5200 above the external surface of suppressor 5000 would be at least twice the material thickness of the suppressor body 5100.

Figure 21:
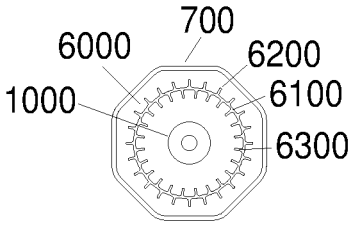
FIG. 21 illustrates 3D printed suppressor 6000 in accordance with an embodiment of the present disclosure.

FIG. 21 illustrates 3D printed suppressor 6000 with internal and external longitudinal internal fins. The internal architecture of suppressor 5000 would be similar to suppressor 2000. FIG. 21 is a cross section in the primary expansion chamber of suppressor 6000. The height of fins 6200 above the external surface of suppressor 6000 would be at least twice the material thickness of the suppressor body 6100. The height of ribs 6300 below the internal surface of suppressor 6000 would be at least twice the material thickness of the suppressor body 6100.

Figure 22:
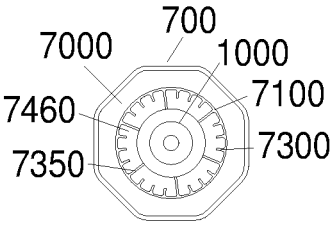
FIG. 22 illustrates 3D printed suppressor 7000 in accordance with an embodiment of the present disclosure.

FIG. 22 illustrates 3D printed suppressor 7000 with a smooth external surface and internal longitudinal fins. The internal architecture of suppressor 7000 would be similar to suppressor 4000 but with the addition of deeper longitudinal fins 7350 and radial partitions 7460. FIG. 21 is a cross section in the primary expansion chamber of suppressor 7000. The height of fins 7300 below the internal surface of suppressor 7000 would be at least twice the material thickness of the suppressor body 7100. The height of fins 7350 below the internal surface of suppressor 7000 would be at least twice the material thickness of the suppressor body 7100. The height of radial partitions 7460 below the internal surface of suppressor 7000 would be at least twice the material thickness of the suppressor body 7100.

Figures 23, 23A, 23B:
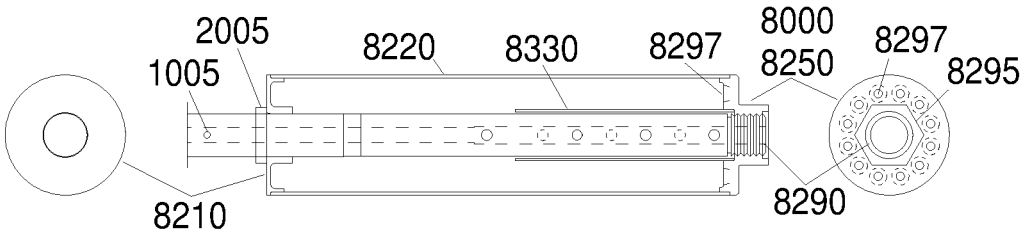
FIG. 23 is a top view of an alternative barrel device 8000 in accordance with an embodiment of the present disclosure.
FIG. 23A is an end view of an embodiment of the disclosure.
FIG. 23B is an end view of an embodiment of the disclosure.

FIG. 23 is a top view of an alternative barrel device 8000 that is not a suppressor but known as a blast forwarding device or linear compensator. Device 8000 would occupy the same space and attach similarly to suppressors 2000, 3000 et al. End piece 8210 would be seam welded to tube body 8220. Internal tube 8330 is seam welded to 8250. Tube body 8220 would be seam welded to end piece 8250 and thus create an enclosure without any internal partitions. Internal diameter of internal tube 8330 is slightly larger than the outside diameter of barrel 1000. The length of internal tube 8330 is sufficient to obscure and cover all of the vent holes in barrel 1000 except the set closest to the gas block. End piece 8250 has a circular array of holes 8297 located outside the hex head feature 8295. Alternative barrel device 8000 would depressurize propellant gases from behind the projectile and exhaust the depressurized gases forward and parallel to the barrel.

FIG. 23A is an end view of an embodiment of the present disclosure.

FIG. 23B is also an end view of an embodiment of the present disclosure.

Figure 24:
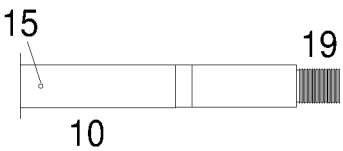
FIG. 24 illustrates a top view of truncated barrel 10 in accordance with an embodiment of the present disclosure.

FIG. 24 illustrates a top view of truncated barrel 10. Shown are gas block vent hole 15 and threaded muzzle 19 in accordance with an embodiment of the present disclosure.

Figures 25, 25A, 25B:
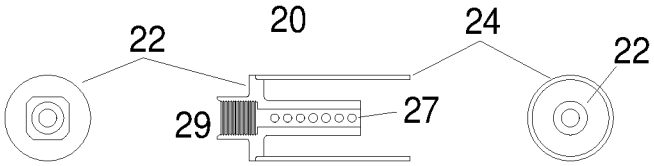
FIG. 25 illustrates a top view of alternative barrel device 20 in accordance with an embodiment of the present disclosure.
FIG. 25A is an end view of an embodiment of the disclosure.
FIG. 25B is an end view of an embodiment of the disclosure.

FIG. 25 illustrates a top view of alternative barrel device 20 which has been section down the barrel centerline. Alternative barrel device 20 is comprised of machined end 22 and tube section 24. Tube section is seam welded to machined end 22. Machined end 22 has internal threads 29 that match with barrel threads 19. Machined end 22 has a single, linear array of holes 27. The intended position of holes 27 is vertically down. The position of holes 27 results in propellant gas aft of the bullet leaving machined end 22 and impinging on the interior surface of tube 24. The impingement of escaping propellant gases will generate a vertical force down on the end of the barrel and counter act the natural rise or lift of the barrel when fired. After impinging on the interior of tube 24, depressurized gases will expand to fill the interior of tube 24 and exit tube 24 in a linear manner parallel and away from the barrel muzzle. FIG. 25*a* is an end view of alternative barrel device 20 looking at the threaded end. FIG. 25*b* is an end view of alternative barrel device 20 looking at the muzzle end. Crush washer or jam nut would be used to locate holes 27 vertically down.

FIG. 25A is an end view of an embodiment of the present disclosure.

FIG. 25B is also an end view of an embodiment of the present disclosure.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

While the forgoing examples are illustrative of the principles of the present disclosure in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the disclosure be limited, except as by the specification and claims set forth herein.

What is claimed is:

1. A suppressor for a barrel of a firearm, the firearm suppressor comprising:

a primary expansion chamber and a plurality of secondary expansion chambers comprising a volume of the suppressor;

a plurality of fins formed into an exterior of the suppressor with the suppressor in an intimate contact with the barrel to increase a heat transfer from the barrel to an atmosphere around the suppressor;

a plurality of ribs formed into the volume of the suppressor with the suppressor in an intimate contact with the barrel to increase heat transfer from the barrel to the volume and thereto the plurality of fins of the suppressor, a plurality of holes configured along a length and a circumference of the barrel to penetrate the barrel and vent a propellant gas into the volume of the suppressor; and a threaded portion of the suppressor configured to attach to a threaded portion of the barrel and to secure the suppressor to the barrel and stiffen the barrel by the attachment of the suppressor to the barrel.

2. The firearm suppressor of claim 1, wherein internal dimensions of the suppressor are determined by an exterior of the barrel and not determined by a caliber of a projectile therein and therefore allows for multi caliber use of the suppressor.

3. The firearm suppressor of claim 1, wherein a counter bore of the barrel allows for a safe use of sabot cartridges without jamming.

4. The firearm suppressor of claim 1, wherein the suppressor is formed of an additive manufacturing of materials that increase thermal conductivity over common materials.

5. The firearm suppressor of claim 1, wherein the exterior wall of the suppressor is corrugated to increase a thermal conductivity thereof.

6. The firearm suppressor of claim 1, further comprising a plurality of troughs recessed into the exterior wall of the suppressor and configured to comprise a fin therein.

7. The firearm suppressor of claim 1, further comprising a plurality of troughs recessed into the exterior wall of the suppressor, the troughs configured to comprise a fin and have a depth twice a thickness of the external wall.

8. The firearm suppressor of claim 1, further comprising a plurality of external surface sections comprising a trough and a fin formed in the suppressor in the exterior wall thereof.

9. The firearm suppressor of claim 1, wherein the plurality of ribs are formed longitudinally in the suppressor and have a height of twice a thickness of the exterior wall thereof.

10. The firearm suppressor of claim 1, wherein the plurality of fins are formed longitudinally in the suppressor and have a height of twice a thickness of the exterior wall thereof.

11. The firearm suppressor of claim 1, wherein the plurality of fins and the plurality of ribs are formed helically along at least a portion of a length of the suppressor.

12. The firearm suppressor of claim 1, further comprising a plurality of radial partitions in the external wall of the suppressor.

13. The firearm suppressor of claim 1, wherein the plurality of holes comprise a linear array of holes along a length of the barrel.

14. The firearm suppressor of claim 1, wherein the plurality of holes comprise a circular array of holes along a circumference of the barrel.

15. A suppressor for a firearm having a barrel guard, the firearm suppressor comprising:

a primary expansion chamber and a plurality of secondary expansion chambers comprising a volume of the suppressor;

a plurality of fins formed into an exterior wall of the suppressor with the suppressor removed from contact with the barrel guard to increase a heat transfer from the barrel guard to an atmosphere around the suppressor;

a plurality of ribs formed into the volume of the suppressor to increase a heat transfer from the barrel guard to the volume of the suppressor and thereto the plurality of fins of the suppressor; and a plurality of holes configured in the barrel guard to allow and promote atmospheric air into and around the barrel guard, barrel guard components and the suppressor, wherein the plurality of fins and the plurality of ribs run a length of the suppressor and extend radially therefrom.

16. The firearm suppressor of claim 15, wherein internal dimensions of the barrel guard are greater than external dimensions of the suppressor.

17. The firearm suppressor of claim 15, wherein the interior surface of the barrel guard does not make contact with the exterior surface of the suppressor.

* * * * *